US007601231B2

(12) United States Patent
Hara et al.

(10) Patent No.: US 7,601,231 B2
(45) Date of Patent: Oct. 13, 2009

(54) HIGH-STRENGTH STEEL PIPE EXCELLENT IN LOW TEMPERATURE TOUGHNESS AND TOUGHNESS AT WELD HEAT-AFFECTED ZONE

(75) Inventors: Takuya Hara, Futtsu (JP); Hitoshi Asahi, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 10/444,743

(22) Filed: May 23, 2003

(65) Prior Publication Data

US 2004/0031544 A1 Feb. 19, 2004

(30) Foreign Application Priority Data

May 27, 2002 (JP) ..... 2002-152379
Dec. 26, 2002 (JP) ..... 2002-377829

(51) Int. Cl.
*C22C 38/04* (2006.01)
*C22C 38/14* (2006.01)
*C22C 38/12* (2006.01)

(52) U.S. Cl. ..... 148/330; 148/332; 148/333; 148/334; 148/335; 148/336; 148/909

(58) Field of Classification Search ..... 148/336, 148/335, 332, 519–521, 590, 591, 909; 420/109, 420/108, 119, 123, 127; 138/170, 171, 142; 428/683, 684
See application file for complete search history.

(56) References Cited

U.S. PATENT DOCUMENTS 5,134,267 A * 7/1992 Atsumi et al. ..... 219/61
5,454,883 A * 10/1995 Yoshie et al. ..... 148/320
5,798,004 A * 8/1998 Tamehiro et al. ..... 148/336
6,183,573 B1 * 2/2001 Fujiwara et al. ..... 148/336
6,188,037 B1 * 2/2001 Hamada et al. ..... 219/61
7,018,488 B2 * 3/2006 Toyooka et al. ..... 148/320

FOREIGN PATENT DOCUMENTS

EP 0757113 2/1997
EP 0861915 9/1998
JP 58-73717 * 5/1983
JP 58-153730 * 9/1983 ..... 148/332

(Continued)

OTHER PUBLICATIONS

Patent abstract of Japanese Publication No. 09165620 published Jun. 24, 1997.
Patent abstract of Japanese Publication No. 09165621 published Jun. 24, 1997.

*Primary Examiner*—Deborah Yee
(74) *Attorney, Agent, or Firm*—Baker Botts LLP

(57) ABSTRACT

A high-strength steel pipe excellent in weldability on site and a method for producing the steel pipe by improving the reliability of the low temperature toughness of a steel are provided. For example, the steel pipe includes elements to enhance hardenability for furthering high-strengthening and also improving toughness at a weld heat affected zone subjected to double or more layer welding. In the method, the steel is made to consist of a structure composed of bainite and/or martensite by containing prescribed amounts of C, Si, Mn, P, S, Ni, Mo, Nb, Ti, Al and N, and, as occasion demands, one or more of B, V, Cu, Cr, Ca, REM, and Mg, and regulating C, Si, Mn, Cr, Ni, Cu, V and Mo. Such elements enhancing hardenability, by a specific relational expression. The diameter of prior austenite grains may be regulated in a prescribed range. The method may include heating a casting to a temperature not lower than the $Ac_3$ point, hot rolling such casting, and thereafter cooling the resulting hot-rolled steel plate at a prescribed cooling rate.

7 Claims, 1 Drawing Sheet

FOREIGN PATENT DOCUMENTS

| | | | |
|---|---|---|---|
| JP | 08-209290 | | 8/1996 |
| JP | 08209290 | | 8/1996 |
| JP | 09-003545 | | 1/1997 |
| JP | 09-041080 | | 2/1997 |
| JP | 09-049025 | | 2/1997 |
| JP | 09041080 | | 2/1997 |
| JP | 10-1744 | * | 1/1998 |
| JP | 1 1036042 | | 2/1999 |
| JP | 1 1172365 | | 6/1999 |
| JP | 11-229078 | | 8/1999 |
| JP | 2000-119749 | | 4/2000 |
| JP | 00199036 | | 7/2000 |
| JP | 2001-303191 | * | 10/2001 |
| JP | 2001-340990 | * | 12/2001 |
| JP | 03136130 | | 5/2003 |
| WO | 9905336 | | 2/1999 |

* cited by examiner

HIGH-STRENGTH STEEL PIPE EXCELLENT IN LOW TEMPERATURE TOUGHNESS AND TOUGHNESS AT WELD HEAT-AFFECTED ZONE

CROSS-REFERENCE TO RELATED APPLICATION(S)

The present application claims priority under 35 U.S.C. §119 from Japanese Patent Application Nos. 2002-152379 filed on May 27, 2002, and Japanese Patent Application No. 2002-377829 filed on Dec. 26, 2002, the entire disclosures of which are incorporated herein by reference.

BACKGROUND OF THE INVENTION

1. Field of the Invention

The present invention relates to methods for producing an ultra-high-strength hot-rolled steel having a tensile strength of, e.g., not lower than 800 MPa, and in particular preferably not lower than 900 MPa, and being a particular degree of toughness of a base steel and at a weld heat-affected zone in the temperature range from −60° C. to 0° C. (hereunder referred to as "low temperature toughness" and "weld heat-affected zone toughness"). The present invention also relates to a method for producing a steel plate, and to a steel pipe composed of a hot-rolled steel. Such ultra-high-strength hot-rolled steels can be, after being further processed and welded, widely used for line pipes for the transport of natural gas or crude oil, pressure vessels, welded structures and the like.

2. Description of the Related Art

In recent years, a steel plate for a line pipe, for water pumping (for a penstock, for example), or for a pressure vessel is required to have improved high strength and low temperature toughness. For example, in the case of a steel plate for a line pipe, various studies have already been undertaken with regard to the production of an ultra-high-strength steel plate having a tensile strength of not lower than 800 MPa (not lower than X100 in the API standard) and high-strength steels excellent in low temperature toughness, weld heat-affected zone toughness and weldability as described in Japanese Patent Nos. 3244986 and 3262972, the entire disclosures of which are incorporated herein by reference. In addition, an ultra-high-strength line pipe having a tensile strength of not lower than 900 MPa and the Production method thereof are described in Japanese Patent publication No. 2000-199036, the entire disclosure of which is incorporated herein by reference.

However, in a steel plate for a line pipe described in the above-mentioned Japanese Patent Nos. 3244986 and 3262972, though the Charpy absorbed energy at −20° C. at a heat-affected zone to which single layer welding is applied is not lower than 100 J and thus very good, weld heat-affected zone toughness may, at times, deteriorate at a beat-affected zone to which double or more layer welding is applied under some welding conditions.

Further, in a steel plate for a line pipe described in the above-mentioned Japanese Patent Nos. 3244986 and 3262972 and also in an ultra-high-strength line pipe described in the above-mentioned Japanese Patent Publication No. 2000-199036, though the Charpy absorbed energy of a base steel at −40° is not lower than 200 J on the average when the number of the specimens (hereunder referred to as "n") subjected to the test by using the same material and under the same test conditions is three and the result is very good, a problem may arise that the Charpy absorbed energy of some specimens is lower than 200 J, and is dispersed widely in some cases.

As a result of studying the problem of the dispersion of low temperature toughness in detail, it was ascertained that Charpy absorbed energy was lower than about 200 J with a probability of about 20 percent when Charpy impact test was performed at −40° C. under an increased number n, and further that Charpy absorbed energy of some specimens was not higher than 100 J and brittle fractured faces were observed on the fractured surfaces of the specimens when the Charpy impact test was performed in the temperature range from −60° C. to not higher than −40° C.

A method for improving low temperature toughness by contriving a welding method is described in Japanese Patent Application No. 2001-336670, the entire disclosure of which is incorporated herein by reference. However, in this publication, it was not explicitly elaborated on that that the method described therein was not immediately applicable because it was not well suitable for mass production, and preferred the introduction of new equipment. In view of the above, the development of a high-strength line pipe excellent in low temperature toughness at both a base steel and a weld is desirable.

SUMMARY OF THE INVENTION

An exemplary embodiment of the present invention provides an ultra-high-strength steel having a tensile strength of, e.g., not lower than 800 MPa and a steel pipe made thereof. The steel can have a particular weld heat-affected zone toughness, especially in shelf energy at a weld heat-affected zone when multi-layer welding is applied; having a Charpy absorbed energy of a base steel at −40° C. being not lower than 200 J on the average and with little dispersion; having excellent low temperature toughness and further being easily weldable at a site. In this manner, shelf energy is Charpy absorbed energy measured in the temperature range where a material ductilely fractures at one hundred percent when a Charpy impact test can be applied at various temperatures to the material that brittlely fractures at a low temperature.

According to the present invention, the chemical components of a steel material and the microstructure thereof were tested for obtaining a high-strength steel that may: (i) have a tensile strength of not lower than 800 MPa (not lower than X100 in the API standard), (ii) have shelf energy of not lower than 100 J at a weld heat-affected zone to which multi-layer welding is applied, (iii) have Charpy absorbed energy of a base steel not lower than 200 J on the average and with little dispersion in the temperature range of not higher than −40° C., and (iv) be easily weldable on site.

Accordingly, first it was determined that the deterioration of low temperature toughness in double layer welding may likely be caused by Nb carbonitride, and confirmed that the reduction of an Nb amount was extremely effective in avoiding the deterioration. Second, with regard to a base steel, low Charpy absorbed energy was observed sometimes under some test condition, and it was clarified that the low Charpy absorbed energy was caused by coarse grains which are partially existing, and it was ascertained that the reduction of an Nb amount may be extremely effective as a countermeasure.

One of the exemplary embodiments of the present invention provides a high-strength steel having a particular low temperature toughness and weld heat-affected zone toughness, in which a P value that was an index of hardenability in an appropriate range may be controlled for enhancing strength that was lowered once by the decrease in an Nb amount.

For example, such exemplary high-strength may contain, in mass,

| | |
|---|---|
| C: | 0.02 to 0.10%, |
| Si: | not more than 0.6%, |
| Mn: | 1.5 to 2.5%, |
| P: | not more than 0.015%, |
| S: | not more than 0.003%, |
| Ni: | 0.01 to 2.0%, |
| Mo: | 0.2 to 0.6%, |
| Nb: | less than 0.010%, |
| Ti: | not more than 0.030%, |
| Al: | not more than 0.070%, and |
| N: | not more than 0.0060%, |

with the balance consisting of Fe and unavoidable impurities; the P value of the steel defined by the following expression being in the range from 1.9 to 3.5; and the microstructure of the steel being mainly composed of martensite and bainite:

$$P=2.7C+0.4Si+Mn+0.8Cr+0.45(Ni+Cu)+2V+Mo-0.5.$$

According to another exemplary embodiment of the present invention, the high-strength steel may contain, in mass,

| | |
|---|---|
| C: | 0.02 to 0.10%, |
| Si: | not more than 0.6%, |
| Mn: | 1.5 to 2.5%, |
| P: | not more than 0.015%, |
| S: | not more than 0.003%, |
| Ni: | 0.01 to 2.0%, |
| Mo: | 0.1 to 0.6%, |
| Nb: | less than 0.010%, |
| Ti: | not more than 0.030%, |
| B: | 0.0003 to 0.0030%, |
| Al: | not more than 0.070%, and |
| N: | not more than 0.0060%, so as to satisfy the expression $Ti-3.4N \geqq 0$, |

with the balance consisting of Fe and unavoidable impurities; the P value of the steel defined by the following expression being in the range from 2.5 to 4.0; and the microstructure of the steel being composed of martensite and bainite:

$$P=2.7C+0.4Si+Mn+0.8Cr+0.45(Ni+Cu)+2V+1.5Mo.$$

One or both of these exemplary embodiments of the high-strength steel may further contain, in mass, one or more of

| | |
|---|---|
| V: | 0.001 to 0.10%, |
| Cu: | 0.01 to 1.0%, |
| Cr: | 0.01 to 1.0%, |
| Ca: | 0.0001 to 0.01%, |
| REM: | 0.0001 to 0.02%, and |
| Mg: | 0.0001 to 0.006%. |

In addition, for the high-strength steel, the average diameter of the prior austenite grains in the steel being not larger than 10 μm.

According to yet another exemplary embodiment of the present invention, the high-strength steel may contain, in mass,

| | |
|---|---|
| C: | 0.02 to less than 0.05%, |
| Si: | not more than 0.6%, |
| Mn: | 1.5 to 2.5%, |
| P: | not more than 0.015%, |
| S: | not more than 0.001%, |
| Ni: | 0.01 to 2.0%, |
| Mo: | 0.1 to 0.6%, |
| Nb: | less than 0.010%, |
| Ti: | not more than 0.030%, |
| B: | 0.0003 to 0.0030%, |
| Al: | not more than 0.070%, and |
| N: | not more than 0.0060%, so as to satisfy the expression $Ti-3.4N \geqq 0$, and further one or more of |
| V: | 0.001 to 0.10%, |
| Cu: | 0.01 to 1.0%, and |
| Cr: | 0.01 to 1.0%, |

with the balance consisting of Fe and unavoidable impurities: the P value of the steel defined by the following expression being in the range from 2.5 to 4.0; the microstructure of the steel being composed of martensite and bainite; and the average diameter of the prior austenite grains in the steel being not larger than 10 μm:

$$P=2.7C+0.4Si+Mn+0.8Cr+0.45(Ni+Cu)+2V+1.5Mo.$$

According to still another exemplary embodiment of the present invention, the high-strength steel may contain, in mass,

| | |
|---|---|
| C: | 0.02 to less than 0.05%, |
| Si: | not more than 0.6%, |
| Mn: | 1.5 to 2.5%, |
| P: | not more than 0.015%, |
| S: | not more than 0.001%, |
| Ni: | 0.01 to 2.0%, |
| Mo: | 0.1 to 0.6%, |
| Nb: | less than 0.010%, |
| Ti: | not more than 0.030%, |
| B: | 0.0003 to 0.0030%, |
| Al: | not more than 0.070%, and |
| N: | not more than 0.0060%, so a__ to satisfy the expression $Ti-3.4N \geqq 0$, and further one or more of |
| V: | 0.001 to 0.10%, |
| Cu: | 0.01 to 1.0%, |
| Cr: | 0.01 to 1.0%, and |
| Ca: | 0.0001 to 0.01%, |

with the balance consisting of Fe and unavoidable impurities; the P value of the steel defined by the following expression being in the range from 2.5 to 4.0; the microstructure of the steel being composed of martensite and bainite; and the average diameter of the prior austenite grains in the steel being not larger than 10 μm:

$$P=2.7C+0.4Si+Mn+0.8Cr+0.45(Ni+Cu)+2V+1.5Mo.$$

A method according to an exemplary embodiment of the present invention for producing a high-strength steel plate having a particular low temperature toughness and weld heat-affected zone toughness is also provided. Such method is capable of producing a steel plate from a casting containing components as described above by, e.g., reheating the casting to a temperature of not lower than the $Ac_3$ point; hot rolling the casting, and thereafter cooling the resulting steel sheet at a cooling rate not lower than 10° C./sec. to a temperature not higher than 550° C. In addition, it is possible to cold-form a cooled steel plate into a pipe; and thereafter apply seam welding to the abutted portion thereof.

According to another exemplary embodiment of the present invention, the high-strength steel may be provided in the pipe having a seam-welded portion. The base steel can contain, in mass,

| | |
|---|---|
| C: | 0.02 to 0.1%, |
| Si: | not more than 0.8%, |
| Mn: | 1.5 to 2.5%, |
| P: | not more than 0.015%, |
| S: | not more than 0.003%, |
| Ni: | 0.01 to 2%, |
| Mo: | 0.2 to 0.8%, |
| Nb: | less than 0.010%, |
| Ti: | not more than 0.03%, |
| Al: | not more than 0.1%, and |
| N: | not more than 0.008%, |

with the balance consisting of Fe and unavoidable impurities; the P value defined by the following expression being in the range from 1.9 to 4.0; and the microstructure being mainly composed of martensite and bainite:

$$P=2.7C+0.4Si+Mn+0.8Cr+0.45(Ni+Cu)+2V+Mo-0.5.$$

The base steel may also contain, in mass,

| | |
|---|---|
| C: | 0.02 to 0.10%, |
| Si: | not more than 0.8%, |
| Mn: | 1.5 to 2.5%, |
| P: | not more than 0.015%, |
| S: | not more than 0.003%, |
| Ni: | 0.01 to 2%, |
| Mo: | 0.1 to 0.8%, |
| Nb: | less than 0.010%, |
| Ti: | not more than 0.030%, |
| B: | 0.0003 to 0.003%, |
| Al: | not more than 0.1%, and |
| N: | not more than 0.008%, so as to satisfy the expression $Ti-3.4N \geqq 0$, |

with the balance consisting of Fe and unavoidable impurities; the P value defined by the following expression being in the range from 2.5 to 4.0; and the microstructure being mainly composed of martensite and bainite:

$$P=2.7C+0.4Si+Mn+0.8Cr+0.45(Ni+Cu)+2V+1.5Mo.$$

Such high-strength steel pipe can further contain, in mass, one or more of

| | |
|---|---|
| V: | 0.001 to 0.3%, |
| Cu: | 0.01 to 1%, |
| Cr: | 0.01 to 1%, |
| Ca: | 0.0001 to 0.01%, |
| REM: | 0.0001 to 0.02%, and |
| Mg: | 0.0001 to 0.006%. |

In addition, the average diameter of the austenite grains in the steel pipe can be not larger than 10 μm.

Further, the base steel can also contain, in mass,

| | |
|---|---|
| C: | 0.02 to less than 0.05%, |
| Si: | not more than 0.8%, |
| Mn: | 1.5 to 2.5%, |
| P: | not more than 0.015%, |

-continued

| | |
|---|---|
| S: | not more than 0.001%, |
| Ni: | 0.01 to 2%, |
| Mo: | 0.1 to 0.8%, |
| Nb: | less than 0.010%, |
| Ti: | not more than 0.030%, |
| B: | 0.0003 to 0.003%, |
| Al: | not more than 0.1%, and |
| N: | not more than 0.008%, so as to satisfy the expression $Ti-3.4N \geqq 0$, and further one or more of |
| V: | 0.001 to 0.3%, |
| Cu: | 0.01 to 1%, and |
| Cr: | 0.01 to 1%, |

with the balance consisting of Fe and unavoidable impurities; the P value defined by the following expression being in the range from 2.5 to 4.0; the microstructure being mainly composed of martensite and bainite; and the average diameter of the austenite grains being not larger than 10 μm:

$$P=2.7C+0.4Si+Mn+0.8Cr+0.45(Ni+Cu)+2V+1.5Mo.$$

The base steel can alternatively contain, in mass,

| | |
|---|---|
| C: | 0.02 to less than 0.05%, |
| Si: | not more than 0.8%, |
| Mn: | 1.5 to 2.5%, |
| P: | not more than 0.015%, |
| S: | not more than 0.003%, |
| Ni: | 0.01 to 2%, |
| Mo: | 0.1 to 0.8%, |
| Nb: | less than 0.010%, |
| Ti: | not more than 0.030%, |
| B: | 0.0003 to 0.003%, |
| Al: | not more than 0.1%, and |
| N: | not more than 0.008%, so as to satisfy the expression $Ti-3.4N \geqq 0$, and further one or more of |
| V: | 0.001 to 0.3%, |
| Cu: | 0.01 to 1%, |
| Cr: | 0.01 to 1%, and |
| Ca: | 0.0001 to 0.01%, |

with the balance consisting of Fe and unavoidable impurities; the P value defined by the following expression being in the range from 2.5 to 4.0; the microstructure being mainly composed of martensite and bainite; and the average diameter of the austenite grains being not larger than 10 μm:

$$P=2.7C+0.4Si+Mn+0.8Cr+0.45(Ni+Cu)+2V+1.5Mo.$$

Another exemplary embodiment of the method for producing the high-strength steel pipe is also provided, which includes reheating the casting containing components described above to a temperature of not lower than the $Ac_3$ point; hot rolling such casting, thereafter cooling the resulting steel sheet at a cooling rate not lower than 1° C./sec. to a temperature not higher than 550° C., cold-forming the cooled steel sheet into a tubular shape, then applying submerged arc welding to the abutted portion from the outer and inner sides thereof, and thereafter subjecting the steel pipe to a pipe expansion. In addition, it is possible to heat the seam-welded portion of the steel pipe to 300° C. to 500° C. before and/or after a pipe expansion.

DETAILED DESCRIPTION

Figure 1:
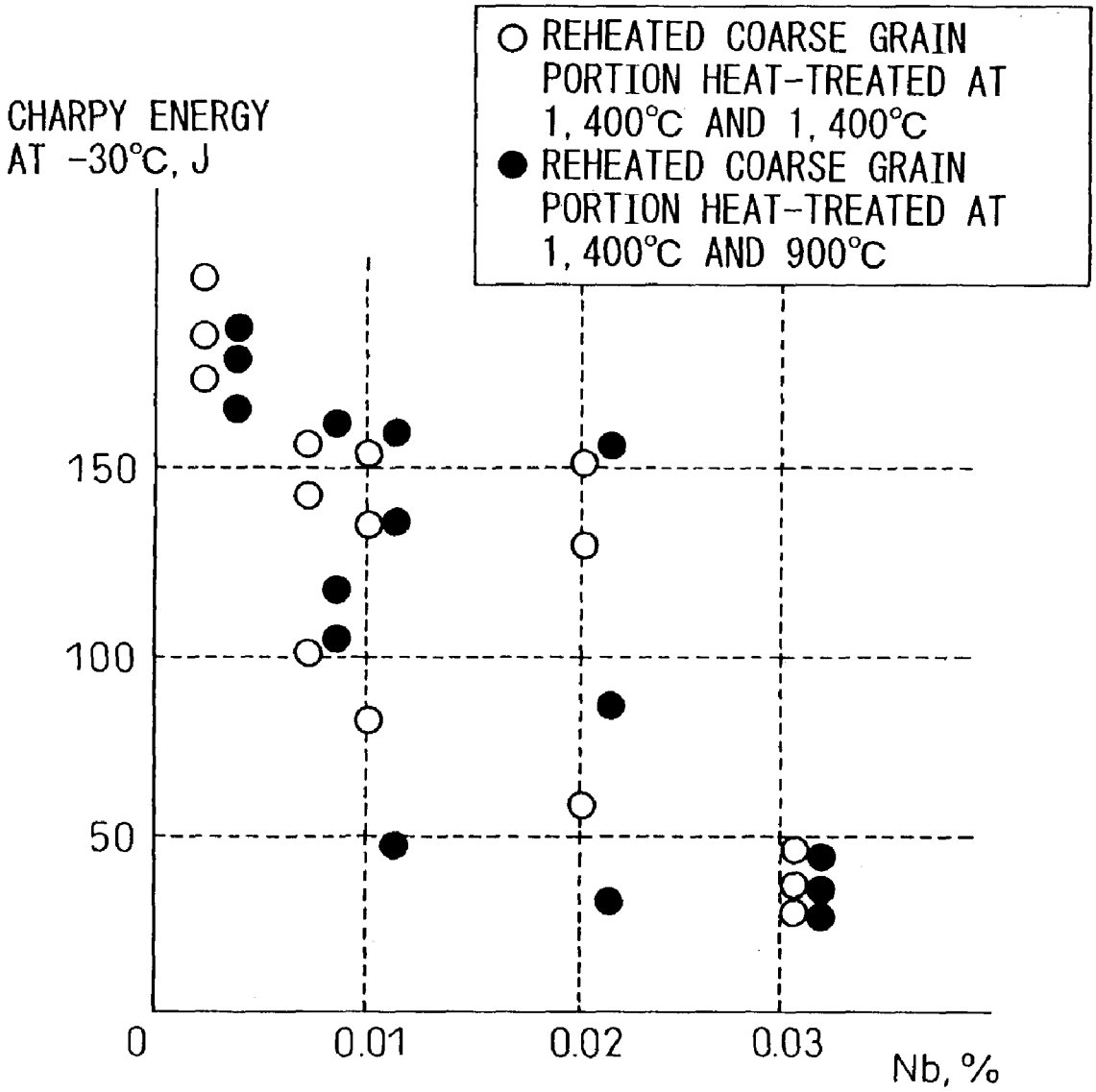
FIG. 1 is an exemplary graph showing the influence of Nb amounts on toughness at reheated coarse grain portions.

As an initial matter, weld heat-affected zone toughness is described herein below. For example, two-pass welding can be applied to various kinds of ultra-high strength steels and then the toughness at welds and weld heat-affected zones at −20° C. may be evaluated by applying a Charpy impact test to specimens each of which had a notch at an intersection of outer and inner welds or at a portion 1 mm away from an intersection of the outer and inner welds. A mating portion can be defined as a point where the beads of double-layer weld intersect with each other on the cross section perpendicular to a welding direction. As a result of the exemplary evaluation, almost one hundred percent of all fractured surfaces may include brittle fractured faces and, in some cases, the Charpy absorbed energy may be at a level not higher than 50 J.

As a result of investigating the fractured surfaces precisely, it can be determined that the brittle fracture originated from the following portions: (i) the region from a mating portion to a portion 1 mm away therefrom in a weld heat-affected zone that has been heated once to a temperature immediately below the melting point and then reheated to a temperature immediately above the $Ac_3$ point, (ii) the region that has been reheated to a temperature immediately below the melting point, and (iii) the region that has been heated once to a temperature immediately below the melting point. The probability of the occurrence of brittle fracture at the respective regions can be about 60% in (i), about 30% in (ii), and about 10% in (iii).

The result may indicate that toughness at a reheated portion, where grains are coarsened by the influence of the one time heating, must be improved. Then, as a result of observing the fractured surfaces further, it has been confirmed that Nb combined carbonitride existed at the initiation point of the brittle fracture and the possibility of improving toughness at a weld heat-affected zone was ascertained, particularly at a reheated coarse grain portion that has been influenced twice heat affects, by decreasing an Nb amount.

On the basis of the above findings, the influence of Nb on weld heat-affected zone toughness has been reviewed by simulating the influence of heat caused by double layer welding through weld reproducing heat cycle test. Steel plates have been produced by controlling the addition amounts of the elements other than Nb in a particular range, and varying the Nb amount in the range from 0.001 to 0.04 in terms of mass percent and test pieces can be prepared. The heat cycle conditions corresponding to 2.5 kJ/mm in terms of heat input may be adopted. For example, the first heat treatment can be applied to the test pieces under the conditions that a test piece may be heated at a heating rate of 100° C./sec. to a temperature of 1,400° C., retained at the temperature for one second, and thereafter cooled at a cooling rate of 15° C./sec. in the temperature range from 500° C. to 800° C., and, in addition to that, the second heat treatment was applied thereto under the conditions that the heating temperature was set at 1,400° C. or 900° C. with the conditions of heating rate, retention time, cooling temperature and cooling rate being identical to the first heat treatment. Further, test pieces of a standard dimension for V-notch Charpy impact tests were prepared in conformity with JIS Z 2202 and the Charry impact tests were performed at −40° C. in conformity with JIS Z 2242.

The results are shown in FIG. 1. It was clarified that, in the steels to which Nb was added to not less than 0.01%, the Charpy absorbed energy was sometimes not higher than 50 J, but, in the steels to which Nb was added to less than 0.01%, Charpy absorbed energy of not higher than 50 J disappeared and the toughness at a reheated coarse grain portion remarkably improved. When the fractured surface of a test piece of an Nb added steel whose Charpy absorbed energy was not higher than 50 J was observed, almost the entire surface was a brittle fractured face and Nb combined carbonitride existed at the initiation point of the brittle fractured face. On the other hand, when the fractured surface of a steel having an Nb content of less than 0.01% after subjected to Charpy impact test was observed, no Nb combined carbonitride existed at the initiation point of the brittlely fractured face. Consequently, the present inventors succeeded in improving toughness at the above-mentioned brittle regions by reducing an Nb amount to less than 0.01%.

Next, the low temperature toughness of a base steel is explained hereunder. It is necessary to make a structure mainly composed of bainite and martensite transformed from particulate unrecrystallized austenite for securing an excellent low temperature toughness in a ultra-high-strength steel pipe having a tensile strength of not lower than 800 MPa, particularly not lower than 900 MPa. When coarse grains are mixed or the fraction of bainite and martensite is not sufficiently high, low Charpy absorbed energy is obtained, the Charpy absorbed energy representing the property of stopping a high-speed ductile fracture. The present inventors applied Charpy impact tests to base steels at −60° C. and precisely investigated the structures in the vicinity of fractured portions of the test pieces that could not achieve the Charpy absorbed energy of not lower than 200 J. As a result of the investigation, it was found that coarse grains 10 to 100 μm in diameter existed in a structure and they caused the reduction of Charpy absorbed energy.

The cast structure of a continuously cast casting containing relatively small amount of alloying elements and having a tensile strength of not higher than 800 MPa is generally composed of a composite structure of ferrite and bainite or Of ferrite and pearlite. When the casting is reheated for hot rolling, new austenite is generated abundantly mainly from ferrite grain boundaries and, when the heating temperature is around 950° C., that is, immediately above the $Ac_3$ point, the composite structure transforms into grain adjusted austenite about 20 μm in average grain diameter. When a steel plate is produced through succeeding hot rolling, the structure has a finer grain due to recrystallization and becomes an almost uniform grain adjusted structure having austenite grains about 5 μm in average diameter. However, it is estimated that, when a steel to which elements to enhance hardenability are added for further strengthening, like a high-strength steel having a tensile strength of not lower than 800 MPa, is hot rolled, coarse grains partially remain and low temperature toughness deteriorates.

In view of this situation, the present inventors investigated the influence of components on a structure in detail and found that, when an Nb amount was reduced to less than 0.01%, grains after hot rolling became fine and coarse grains partially existing disappeared. The effect of the reduction of an Nb amount can be explained as follows.

To begin with, the cause of the fact that coarse grains partially remain when an Nb amount is large is explained. An ultra-high-strength steel having a tensile strength of not lower than 800 MPa, particularly not lower than 900 MPa, generally contains relatively abundantly alloying elements, such as Mn, Ni, Cu, Cr and Mo, that provide a high hardenability. When such a steel is produced through continuous casting or the like, the structure of a casting after it is cooled to the room temperature is made to consist of a single phase of coarse bainite (hereunder referred to as "bainite"), the crystal grain diameter of which is not smaller than 1 mm in terms of prior austenite grain diameter, a single phase of martensite {hereunder referred to as "martensite"), or a structure mainly composed of bainite and martensite (hereunder referred to as "bainite and martensite dominant structure"). Such a structure contains fine retained austenite in its grains. Note that, though the structures of both bainite and martensite are lath structures and they can hardly be identified with an optical microscope, they can be identified by hardness measurement.

When a casting having such a cast structure as described above is heated to a temperature in the range from 900° to 1,000° C., the reaction of generating new austenite grains by the transformation from prior austenite grain boundaries (hereunder referred to as "normal ferrite/austenite transformation") and the reaction of generating coarse austenite grains not smaller than 1 mm in size by the easy growth and consolidation of the aforementioned retained austenite (hereunder referred to as "abnormal ferrite/austenite transformation") are generated.

When Nb is further added to such a steel, fine Nb carbide forms and therefore the growth of grains during heating is suppressed. Therefore, when a steel is heated in the temperature range from a temperature immediately above the $Ac_3$ point to 1,100° C. for example, the growth of austenite grains generated by ordinary austenite transformation, namely secondary recrystallization, is suppressed. As a result, austenite grains not smaller than 1 mm in size, almost the same size as prior austenite grains in a casting, are generated partially by abnormal ferrite/austenite transformation. If such coarse austenite grains are generated in a steel during heating, as recrystallization after hot rolling hardly occurs, the austenite grains remain partially as grains not smaller than 50 μm in size and those coarse grains cause the deterioration of low temperature toughness.

When a steel is heated in the temperature range of not lower than 1,150° C., Nb combined carbide that acts as pinning grains dissolves and the growth of grains generated by ordinary austenite transformation from prior austenite grain boundaries, namely secondary recrystallization, is accelerated, and, by so doing, the size of austenite grains is properly adjusted. When a casting having such a structure is hot rolled, though the average grain diameter increases to soma extent, coarse grains about 50 μm in size are not observed at all. However, coarse grains smaller than about 20 μm in size still remain.

In contrast with the above, since a casting of a steel wherein an Nb amount is reduced to less than 0.01% has little Nb carbide, the effect of suppressing secondary recrystallization is weak. Therefore, when the casting is heated in the temperature range from 950° C. to 1,100° C., secondary recrystallization is accelerated and, by so doing, the grains generated by normal austenite transformation erode coarse grains generated by abnormal ferrite/austenite transformation and the structure becomes uniform. When a casting having such a structure is hot rolled, a uniform structure having grains about 10 μm in average diameter is obtained and coarse grains of not smaller than 20 μm do not remain any more. Note that, as the coarsening of austenite grains after secondary recrystallization is suppressed as the heating temperature lowers, grains after hot rolling become fine.

As explained above, the present inventors found that, even in a casting to which alloying elements with a high hardenability were added relatively abundantly for high-strengthening and which had a single phase of bainite, a single phase of martensite, or a bainite and martensite dominant structure, those being apt to generate coarse austenite grains partially by abnormal ferrite/austenite transformation during heating, it was possible to conspicuously suppress the generation of coarse grains by reducing an Nb amount to less than 0.01%. On the basis of the finding, the present inventors succeeded in the development of a high-strength steel as a base steel having excellent low temperature toughness of not lower than 200 J in terms of Charpy absorbed energy when the base steel was subjected to a Charpy impact test in the temperature range from −60° C. to lower than −40° C.

However, it is thought that, when an Nb amount is reduced, the recrystallization temperature lowers and unrecrystallization rolling is not sufficiently performed. The present inventors investigated the behavior of austenite recrystallization in a steel to which 0.005% Nb was added and a steel to which 0.012% Nb was added, both the steels containing, in mass, 0.05% C, 0.25% Si, 2% Mn, 0.01% P, 0.001% S, 0.5% Ni, 0.1% Mo, 0.015% Ti, 0.0010% B, 0.015% Al, 0.0025% N, 0.5% Cu and 0.5% Cr. As a result of the investigation, it was clarified that the recrystallization temperature of either of the steels was in the temperature range from 900° C. to 950° C. regardless of the addition amount of Nb, and, in a steel to which Mn, Ni, Cu, Cr and Mo were added abundantly, the recrystallization temperature did not change regardless of the addition of Nb. Therefore, it was proved that it was not essential to add Nb from the viewpoint of the recrystallization of austenite.

Further, as the reduction of an Nb amount causes the decrease of strength, the present inventors studied the addition amount of elements to enhance hardenability and contrived to secure both strength and low temperature toughness simultaneously by controlling a P value, that was an index of hardenability, in an appropriate range. As a result of investigating, in detail, the influence of alloying elements on hardenability of a steel wherein an addition amount of Nb was reduced to less than 0.01%, it was clarified that, in the case of a steel not containing B, by defining the P value to $P=2.7C+0.4Si+Mn+0.8Cr+0.45(Ni+Cu)+2V+Mo-0.5$, hardenability was evaluated properly and the appropriate range of the P value was from 1.9 to 3.5. On the other hand, it was clarified that, in the case of a steel to which B is added, the P value was defined by $P=2.7C+0.4Si+Mn+0.8Cr+0.45(Ni+Cu)+2V+1.5Mo$ and the appropriate range of the P value was from 2.5 to 4.0. By controlling a P value to an appropriate range, the present inventors succeeded in obtaining a good balance between the target strength and low temperature toughness without the impairment of weld heat-affected zone toughness and weldability on site.

Further, when a weld heat-affected zone was heated to a temperature of not lower than 300° C., fine martensite-austenite (MA) was tempered and, therefore, a high Charpy absorbed energy was obtained stably. On the other hand, when a weld heat-affected zone of a steel to which Nb was added at not less than 0.01% was heated to a temperature of not lower than 300° C., though fine martensite-austenite (MA) may be tempered, the brittlement occurred, at the same time, caused by the precipitation of Nb and therefore a conspicuous effect, as expected in the present invention, has not been seen.

Next, exemplary reasons for defining the steel plate and those for such defining of the base steel are described herein below.

C can be extremely effective for improving the strength and hardenability of a steel by the dissolution of C or the precipitation of carbonitride in the steel, and the lower limit of a C content is set at 0.02% in order to achieve a target strength by making a structure consist of bainite, martensite, or a bainite and martensite dominant structure. On the other hand, when a C content is excessive, low temperature toughness of a steel material and at a weld heat-affected zone may deteriorate and, thus, the weldability at a site deteriorates conspicuously, for example low temperature cracks occur after welding, and therefore the upper limit of a C content is set at 0.10%. It is preferable to set the upper limit of a C content at 0.07% to further improve low temperature toughness. It may be preferable to control a C content to be not less than 0.03% for an improving strength. On the other hand, if strength is too high, the shape of a steel pipe may be impaired after pipe expansion and the roundness may deteriorate, and therefore it is preferable to control the C content to less than 0.05%. The roundness may be obtained by measuring the diameter of a steel pipe at plural portions, for example measuring the diameter passing through the center of a steel pipe at four portions apart from the seam-weld at every angle of 45 degrees, calculating the average value, deducting the minimum diameter from the maximum diameter, and then dividing the deduction by the average value.

Si preferably has the function of deoxidization and the effect of enhancing strength. However, when Si is added excessively, weld heat-affected zone toughness and weldability on site are remarkably deteriorated and therefore the upper limit of an Si content is set at 0.8%. A preferable upper limit of an Si amount can be 0.6%. As Al and Ti may also have the function of a deoxidization, similar to Si, in a steel according to the present invention, it is preferable to adjust an Si content according to the contents of Al and Ti. The lower limit of an Si content is not particularly specified but Si is generally contained by not less than about 0.01% as an impurity in a steel.

Mn can be an important or even an indispensable element for making the microstructure of a steel according to the present invention which can consist of a bainite and martensite dominant structure, and for securing a good balance between strength and low temperature toughness, and thus the lower limit of an Mn content is set at 1.5%. On the other hand, if Mn is added excessively, not only hardenability may be increased and weld heat-affected zone toughness and weldability at a site are deteriorated, but also center segregation may be accelerated and the low temperature toughness of a steel material is deteriorated. For those reasons, the upper limit of an Mn content can be set at 2.5%. A center segregation may be defined as the state in which the segregation of components generated caused by solidification in the vicinity of the center of a casting in a casting process does not disappear even after being subjected to the subsequent processes and remains in the vicinity of the center of the thickness of the steel plate.

P and S can also be impurity elements. For example, P can accelerate the center segregation, and may, at the same time, improve low temperature toughness by intergranular fracture. S lowers ductility and toughness by the influence of MnS, that elongates during hot rolling, in a steel. Therefore, in the present invention, the upper limits of a P content and an S content are set at 0.015% and 0.003% respectively for further improving low temperature toughness and weld heat-affected zone toughness. P and S are impurities and the lower limits of their contents are about 0.003% and 0.0001% respectively under current technology. Further, it is possible to suppress the precipitation of sulfide such as MnS in a steel by restricting an S content to not more than 0.001%. For that reason, it may be preferable to restrict the content of S to be not more than 0.001% for suppressing the deterioration of ductility and toughness.

Ni, compared with Mn, Cr or Mo, is able to reduce a formation of a hardened structure which is harmful to low temperature toughness at a center segregation zone formed at hot rolling. Ni can also be effective to increase toughness at weld heat-affected zone. Since the effects are insufficient with an Ni content of less than 0.01%, the lower limit thereof is set at 0.01%. Further, it is preferable to set the lower limit of an Ni content at 0.3% for the improvement of weld heat-affected zone toughness. On the other hand, if an Ni content is excessive, not only the economical efficiency deteriorates because Ni is expensive but also weld heat-affected zone toughness and weldability at a site deteriorate, and therefore the upper limit of an Ni content is set at 2.0%. The addition of Ni may also be effective in the prevention of surface cracks caused by Cu during continuous casting and hot rolling. When Ni is added for that purpose, it is preferable to add Ni to not less than one-third of the Cu content.

Mo can be added for improving the hardenability of a steel and obtaining bainite, martensite, or a bainite and martensite dominant structure, those being excellent in a balance between strength and low temperature toughness. The effects may be enhanced further by adding Mo in combination with the addition of B. Further, by the coexistence of Mo with B, the effects of suppressing the recrystallization of austenite during controlled rolling and thus fining an austenite structure are obtained. For obtaining those effects of Mo addition, the lower limit of an Mo content may be set at 0.2% in the case of a steel to which B is not added, and approximately the same can be set at 0.1% in the case of a steel to which B is added. On the other hand, if Mo is added in excess of 0.8%, not only a production cost may increase, but also weld heat-affected zone toughness and weldability at a site deteriorate regardless of the addition of B. Therefore, the upper limit of an Mo content is set at 0.8%. Here, a preferable upper limit of an Mo content is 0.6%.

Nb suppresses the recrystallization of austenite during controlled rolling, makes an austenite structure fine by the precipitation of carbonitride, and also contributes to the improvement of hardenability. In particular, the effect of the improvement of hardenability by the addition of Nb is synergistically enhanced by its coexistence with B. However, if Nb is added to not less than 0.01%, coarse grains are partially generated, thus a percent fracture in an impact test is lowered and weld heat-affected zone toughness is deteriorated when double or more layer welding is applied. Further, in that case, weldability at a site is also deteriorated. For those reasons, the upper limit of an Nb content is set at less than 0.01%. A preferable Nb content is not more than 0.005%. Further, it is not necessary to add Nb as long as a P value defined by the expression $P=2.7C+0.4Si+Mn+0.8Cr+0.45(Ni+Cu)+2V+Mo-0.5$ is in the range from 1.9 to 4.0, preferably from 1.9 to 3.5, in a steel not containing B or a P value defined by the expression $P=2.7C+0.4Si+Mn+0.8Cr+0.45(Ni+Cu)+2V+1.5Mo$ is in the range from 2.5 to 4.0. However, Nb is usually contained at not less than 0.001% in a steel as an impurity.

Ti generally forms fine nitride in a steel and suppresses the coarsening of austenite during reheating. Further, in a B added steel, Ti reduces dissolved N that is harmful to the improvement of hardenability by fixing N as nitride and thus improves hardenability further. Furthermore, when an Al content is not more than 0.005%, Ti forms an oxide in a steel. The Ti oxide functions as intragranular transformation product nuclei at a weld heat-affected zone and thus makes the structure of the weld heat-affected zone fine. It is preferable to set the lower limit of a Ti content to 0.001% for securing the aforementioned effects of Ti addition. Further, it is preferable to regulate the lower limit of a Ti content to not less than 3.4N for stably obtaining the effects caused by the formation of nitride and the fixation of dissolved N. On the other hand, if an addition amount of Ti is excessive, nitride coarsens, fine carbide is generated, precipitation hardening occurs and, therefore, weld heat-affected zone toughness is deteriorated. Further, in that case, as in the case where Nb is added to not less than 0.01%, coarse grains can be partially generated and thus low temperature toughness is deteriorated. For those reasons, the upper limit of a Ti content can be set at 0.030%.

Al may be added in a steel as a deoxidizer and also has the function of fining a structure. However, if the Al content exceeds 0.1%, nonmetallic inclusions of an aluminum oxide system increase, thus the cleanliness of a steel is impaired, and also the toughness of a steel material and at a weld heat-affected zone is deteriorated. For those reasons, the upper limit of an Al content is set at 0.1%. A preferable upper limit thereof can be 0.07% and the optimum Al content may be not more than 0.06%. Further, as Si and Ti also have the same function of deoxidization as Al has, in a steel according to the present invention, it is preferable to control an Al content in consideration of the contents of Si and Ti. The lower limit of an Al content is not specified, but Al is usually contained at not less than 0.005%.

N, when it is added in excess of 0.008%, can generate surface defects on a casting and causes the deterioration of weld heat-affected zone toughness by dissolved N and Nb nitride. Therefore, the upper limit of an N content is set at 0.008%. A preferable upper limit of an N content can be 0.006%. The lower limit of an N content is not specified because the lower the N content, the more preferable the results are. However, N is usually contained at about 0.003% as an impurity.

A steel according to the present invention contains the components explained above as basic components. In addition, for contriving to further improve strength and toughness and expand the producible size of steel materials, one or more of B, V, Cu, Cr, Ca, REM and Mg may be added to the contents specified below.

B can be an element effective in enhancing the hardenability of a steel by adding a trace amount of B and in obtaining a bainite and/or martensite dominant structure that is one of the objects of the present invention. Further, B enhances the effect of Mo in improving the hardenability of a steel according to the present invention and accelerates the effect of improving hardenability synergistically by the coexistence of B with Nb. Those effects are not secured when the B content is less than 0.0003%. Therefore, the lower limit of a B content can be set at 0.0003%. On the other hand, if B is added excessively, not only is the formation of brittle grains such as $Fe_{23}(C,B)_6$ accelerated and, thus, low temperature toughness is deteriorated but, also, the effect of B in improving hardenability is impaired. Therefore, the upper limit of a B content is set at 0.0030%.

V has almost substantially the same function as Nb has. Though the effects of V are weaker than those of Nb with a single addition of V, the coexistence of V with Nb further enhances the effects of improving low temperature toughness and weld heat-affected zone toughness. Since those effects are likely insufficient with a V content of less than 0.001%, it is preferable to set the lower limit thereof to 0.001%. On the other hand, if the addition amount of V exceeds 0.3%, weld heat-affected zone toughness, particularly weld heat-affected zone toughness when double or more layer welding is applied, is deteriorated, coarse grains caused by abnormal ferrite/austenite transformation during heating for hot rolling are generated, thus low temperature toughness is deteriorated and, further, weldability on site is impaired. For those reasons, it is preferable to set the upper limit of a V content at 0.3%. A still preferable upper limit of a V content is 0.1%.

Cu and Cr are elements that can enhance the strength of a base steel and at a weld heat-affected zone, and it is preferable to include these elements at, e.g., not less than 0.01% respectively to obtain those effects. On the other hand, if the content of Cu or Cr is excessive, weld heat-affected zone toughness and weldability on site can be deteriorated considerably. Therefore, each of the upper limits of the contents of Cu and Cr may be set at 1.0%.

Ca and REM can have the functions of controlling the shape of sulfide such as MnS in a steel and improving the low temperature toughness of the steel. It is preferable to set each of the lower limits of the contents of Ca and REM at 0.0001%. On the other hand, if Ca is added in excess of 0.01% or REM in excess of 0.02%, CaO—CaS or REM-CaS is generated in large quantities, which forms large clusters and large inclusions and, thus, the cleanliness of a steel is impaired and weldability on site is deteriorated. For those reasons, it is preferable to set the upper limits of the contents of Ca and REM at 0.01% and 0.02% respectively. Further, a still preferable upper limit of a Ca content can be 0.006%.

In addition, when a strength of not lower than 950 MPa is required, it is preferable to further regulate the contents of S and O in a steel to 0.001% and 0.002% respectively. Furthermore, it is preferable to control an ESSP value, that is an index related to the shape control of sulfide system mixtures, (ESSP being defined by the expression $ESSP=(Ca)[1-124(O)]/1.25S$) in the range from 0.5 to 10.0.

Mg has the functions of forming finely dispersed oxide, suppressing the coarsening of austenite grains at a weld heat-affected zone, and thus improving low temperature toughness. The lower limit of an Mg content is set at 0.0001% for securing those effects. On the other hand, if an Mg content exceeds 0.006%, coarse oxide can be generated and thus low temperature toughness is deteriorated. Therefore, the upper limit of an Mg content may be set at 0.006%.

In addition to the values of the content of each of the addition elements, the exemplary embodiment according to the present invention may provide a regulation of a P value, which is an index of hardenability within an appropriate range, to obtaining an excellent balance between strength and low temperature toughness. A P value can be defined differently according to the presence of B in a steel: in a steel not containing B, a P value is defined by the expression $P=2.7C+0.4Si+Mn+0.8Cr+0.45(Ni+Cu)+2V+Mo-0.5$; and in a steel containing B, a P value is defined by the expression $P=2.7C+0.4Si+Mn+0.8Cr+0.45(Ni+Cu)+2V+1.5Mo$. When a P value is less than 1.9 in a steel without B addition or less than 2.5 in a steel with B addition, tensile strength of not lower than 800 MPa is not obtained, and therefore those values are determined to be the lower limits in respective steels. On the other hand, when a P value exceeds 4.0 in either of the steels, weld heat-affected zone toughness and weldability at a site are deteriorated, and therefore the value is determined to be the upper limit in either of the steels. Furthermore, it is preferable to determine the upper limit of a P value to be 3.5 in a steel without B addition. In conclusion, an adequate range of a P value is determined to be: from 1.9 to 4.0, preferably from 1.9 to 3.5, in a steel without B addition; and from 2.5 to 4.0 in a steel with B addition.

Next, a microstructure according to an exemplary embodiment of the present invention is described herein below. In particular, to attain a high strength of not lower than 800 MPa in terms of tensile strength and securing good low temperature toughness, it is preferable to control the amount of bainite, martensite, or a bainite and martensite dominant structure in the range from 90 to 100% in terms of a bainite and martensite fraction. The balance seems to be retained austenite, but it is not trivial to identify with an optical microscope. The fact that a bainite and martensite fraction may be in the range from 90 to 100% can be defined by the following two conditions. In particular, this can be done by (i) by confirming that polygonal ferrite is not generated by an optical micrograph, a scanning electron micrograph, or a transmission electron micrograph, and (ii) defining that a bainite and martensite fraction is in the range from 90 to 100% as follows according to hardness: to calculate the hardness of 100% martensite from the amount of C using the expression $Hv=270+1,300C$, such that C may be the amount of C expressed in terms of mass percent; and when the hardness of a steel material is in the range from 70 to 100% of the hardness of the 100% martensite, it is defined that the bainite and martensite fraction of the steel material is in the range from 90 to 100%.

In addition, when a bainite and martensite fraction is in the range from 90 to 100%, tensile strength and a C amount preferably satisfy the following expression: $0.7\times(3,720C+869)<TS$, wherein TS is tensile strength [in terms of MPa] of a steel obtained and C is a C amount [in terms of mass percent].

For obtaining excellent low temperature toughness in the direction of a cross section in the case of a steel pipe for a line pipe for example, it is necessary to optimize an austenite phase before the austenite phase transforms into a ferrite phase, or what is called the structure of prior austenite, at the time of cooling, and to make the final structure of a steel material efficiently fine. For that reason, prior austenite is required to consist of unrecrystallized austenite and also the average grain diameter thereof is limited to not larger than 10 μm. By so doing, extremely good balance between strength and low temperature toughness is obtained.

The diameter of prior austenite grains preferably indicates the diameter of grains including a deformation band and a twin boundary that have the same function as an austenite grain boundary. The diameter of prior austenite grains can be determined, for example in conformity with JIS G 0551, by dividing the full length of a straight line drawn in the direction of the steel sheet thickness by the number of the points where the straight line intersects with the grain boundaries of the prior austenite existing on the straight line, by using an optical micrograph. The lower limit of the average diameter of prior austenite grains is not specified, but the detectable lower limit is about 1 m according to a test with an optical micrograph. Here, a preferable range of a prior austenite grain diameter is from 3 to 5 μm.

In the production of a high-strength steel excellent in low temperature toughness according to an exemplary embodiment of the present invention, it is desirable to carry out hot rolling under the conditions described below. A reheating temperature is determined to be in a temperature range wherein the structure of a casting substantially consists of a single austenite phase, namely the Ac3 point is determined to be the lower limit of a reheating temperature. When a reheating temperature exceeds 1,300° C., crystal grains coarsen and, therefore, it is preferable to limit a reheating temperature to not higher than 1,300° C. With regard to rolling after the reheating, it is preferable to firstly carry out recrystallization rolling and secondly carry out unrecrystallization rolling. Note that, though a recrystallization temperature varies according to steel components, it is in the range from 900° C. to the reheating temperature, and therefore the preferable temperature range during recrystallization rolling is from 900° C. to 1,100° C. and the preferable temperature range during unrecrystallization rolling is from 750° C. to 880° C. Thereafter, e.g., cooling is applied at a cooling rate of not lower than 1° C./sec. up to an arbitrary temperature of not higher than 550° C. The upper limit of a cooling rate is not particularly specified, but a preferable range thereof is from 10 to 40° C./sec. The lower limit of a cooling end temperature is neither particularly specified, but a preferable range thereof is from 200° C. to 450° C.

By carrying out hot rolling under such conditions of steel components, heating and rolling as described above, a ultra-high-strength steel sheet excellent in low temperature toughness can be obtained. Further, by cold-forming the hot-rolled steel plate into a pipe, and thereafter applying double or more layer seam welding to an abutted portion, a ultra-high-strength steel pipe excellent in low temperature toughness and weld heat-affected zone toughness can be produced. That is, according to the present invention, it is possible to mitigate welding conditions in the production of a steel pipe having such a sheet thickness when double or more layer welding is required. It is preferable to employ arc welding, particularly submerged arc welding, for seam welding.

The size of a high-strength steel pipe used for a line pipe according to an exemplary embodiment of the present invention is usually about 450 to 1,500 mm in diameter and about 10 to 40 mm in wall thickness. In order to produce a steel pipe of such size efficiently, the production method according to the present invention can preferably include the procedures of: producing a pipe in a UO process where a steel plate is formed into a U-shape and then into an O-shape; tack-welding the abutted portion; thereafter applying submerged arc welding from the inner and outer sides, and thereafter securing roundness by pipe expansion.

Submerged arc welding is the a procedure in which the dilution of a weld metal by a base steel can be large. Therefore, for controlling the chemical components of a weld metal in a range wherein desired properties are obtained, it is necessary to select a weld material in consideration of the dilution by a base steel. As an example, welding may be carried out by using: a weld wire containing Fe as the main component, 0.01 to 0.12% C, not more than 0.3% Si, 1.2 to 2.4% Mn, 4.0 to 8.5% Ni, and 3.0 to 5.0% Cr+Mo+V; and a flux of a agglomerated type or a fused type.

The ratio of dilution by a base steel varies depending on welding conditions, particularly a weld heat input, and, in general, the ratio of dilution by a base steel increases with the increase of a heat input. However, under the condition of slow welding speed, the ratio of dilution by a base steel does not increase even when a heat input increases. For securing sufficient weld penetration when one pass welding is applied to an abutted portion from the outer side and the inner side thereof, it is preferable to limit a heat input and a welding speed to the following ranges.

When a heat input is less than 2.5 kJ/mm, weld penetration can decrease but, on the other hand, when a heat input is larger than 5.0 kJ/mm, a weld heat-affected zone softens and weld heat-affected zone toughness somewhat may deteriorate. Therefore, it is preferable to limit a heat input in the range from 2.5 to 5.0 kJ/mm.

When a welding speed is lower than 1 m/min., the welding work is somewhat inefficient as seam welding for a line pipe but, on the other hand, when a welding speed exceeds 3 m/min., a bead shape is hardly stable. Therefore, it is preferable to limit a welding speed in the range from 1 to 3 m/min.

Roundness can be improved by applying pipe expansion after seam welding. It is preferable to set a pipe expansion rate at not less than 0.7% for improving roundness by applying plastic deformation. On the other hand, if a pipe expansion rate exceeds 2%, the toughness of both a base steel and a weld deteriorates to some extent caused by plastic deformation. For those reasons, it is preferable to determine a pipe expansion rate to be in the range from 0.7 to 2%. Here, a pipe expansion rate is defined by the value obtained by subtracting a circumference before pipe expansion from a circumference after pipe expansion, dividing the resulting value by the circumference before pipe expansion, and expressing the resulting value as a percentage.

After seam welding, when a seam weld is heated to not lower than 300° C. before and/or after pipe expansion, a massive mixture of martensite and austenite (referred to as "MA") generated at a weld heat-affected zone can be decomposed into a bainite and martensite dominant structure and fine hard cementite and, therefore, weld heat-affected zone toughness improves. On the other hand, if a heating temperature exceeds 500° C., a base steel softens. For those reasons, it is preferable to limit the heating temperature in the range from 300° C. to 500° C. Though the influence of time is not large, it is preferable that the time is about 30 seconds to 60 minutes. A preferable range thereof is about 30 seconds to 50 minutes. Further, when heating is applied after pipe expansion, a processing strain converging at the toe of a weld recovers and thus weld heat-affected zone toughness improves.

When a test piece is cut out from a weld heat-affected zone, specularly polished and etched, and then observed with a scanning electron microscope, it is seen that an MA formed at a weld heat-affected zone is entirely composed of a white massive substance. When an MA is heated to 300° C. to 500° C., it is decomposed into a bainite and martensite dominant structure having fine precipitates in the grains and cementite, and these can be distinguished from the MA. Further, when a test piece is subjected to repeller etching or nitral etching after specularly polished and observed with a scanning electron microscope too, an MA can be distinguished from another MA decomposed into a bainite and martensite dominant structure and cementite by judging whether or not fine precipitates exist in grains.

When a seam weld is heated, it is preferable to apply the heating to a weld metal and the weld heat-affected zone of a base steel. A weld heat-affected zone is the area within about 3 mm from an intersection of a weld metal and a base steel and therefore it is preferable to heat at least the area including a base steel within 3 mm from an intersection of a weld metal and a base steel. However, it is technically difficult to heat such a narrow area and therefore it is realistic to apply a heat treatment to the area within about 50 mm from an intersection of a weld metal and a base steel. Here, there is no inconvenience such as the deterioration of base steel properties caused by a heating to a temperature in the range from 300° C. to 500° C. A gas burner of a radiation type or an induction heater can be adopted for the heating of a seam weld.

As it has been explained above, the exemplary embodiment of the present invention enables productions of a ultra-high-strength steel plate having a tensile strength of not lower than 800 MPa and of a steel pipe made thereof: the steel plate being excellent in weld heat-affected zone toughness when double or more layer welding is applied; Charpy absorbed energy of the base steel in the temperature range of not higher than −40° C. being not lower than 200 J on the average and little dispersing; the steel plate having excellent low temperature toughness; and further the steel plate being excellent in weldability at a site. By so doing, it is made possible to apply the steel plate and the steel pipe for a line pipe for the transport of natural gas or crude oil, a steel plate for water pumping, a pressure vessel, a welded structure or the like, these being used in harsh environments.

EXAMPLE 1

Steels containing chemical compositions shown in Tables 1 and 2 (Table 2 being continued from Table 1) may be melted and continuously cast into castings 240 mm in thickness. The resulting castings can be reheated to 1,100° C., thereafter rolled in the recrystallization temperature range from 900° C. to 1,100° C., further rolled in the uncrystallization temperature range from 750° C. to 880° C., and thereafter cooled at a cooling rate of 5 to 50° C./sec. up to a temperature not higher than 420° C. by water cooling, and by so doing, steel plates 10 to 20 mm in thickness were produced.

An average diameter of prior austenite grains can be obtained by the straight line crossing segment method in the thickness direction conformity with JIS G 0551. A bainite and martensite fraction was obtained as follows. Initially, polygonal ferrite is likely not generated by observing a structure in an optical micrograph in conformity with JIS G 0551. Then, the Vickers hardness may be measured imposing a weight of 1 Kg and the measured value was defined as $HV_{BM}$ in conformity with JIS Z 2244. The ratio $\alpha_{BM}$ of $HV_{BM}$ to the hardness of 100% martensite calculated by the expression Hv=270+1,300C, e.g., $Hv_{BM}/HV=\alpha_{BM}$, can be obtained. Thereafter, using the definition of a bainite and martensite fraction being 90% in the event of $\alpha_{BM}=0.7$ and the same being 100% in the event of $\alpha_{BM}=1$, a bainite and martensite fraction $F_{BM}$ may be calculated by the expression $F_{BM}=100\times(1/3\times\alpha_{BM}+2/3)$.

Yield strength and tensile strength in the direction of the rolling of a steel plate (hereunder referred to as "L direction") and in the direction perpendicular to the rolling direction (hereunder referred to as "C direction") can be evaluated by the API full thickness tensile test. A Charpy impact test may be carried out at −40° C. with the test repetition frequency n being three in conformity with JIS Z 2242 by using V-notched test pieces of a standard size, the length of the test pieces being in the L and C directions, prepared in conformity with JIS Z 2202. A Charpy absorbed energy can be evaluated as the average of the values obtained by the three repeated measurements. In addition, another Charpy impact test may be carried out in the temperature range from −60° C. to lower than −40° C. with the test repetition frequency n varied from 3 to 30, and the probability that a Charpy absorbed energy is not lower than 200 J (hereunder referred to as "low temperature toughness reliability") can be evaluated in terms of percentage.

Weld heat-affected zone toughness can be evaluated by subjecting a specimen to heat treatments corresponding to welding twice, each welding having a heat input of 2.5 kJ/mm, using a weld reproducing heat cycle test apparatus. That is, the first heat treatment may be applied to a specimen under the conditions that the specimen can be heated at a heating rate of 100° C./sec. to a temperature of 1,400° C., retained at the temperature for one second, and thereafter cooled at a cooling rate of 15° C./sec. in the temperature range from 500° C. to 800° C., and, in addition to that, the second heat treatment may be applied thereto under the conditions that the heating temperature was set at 1,400° C. or 900° C. with the conditions of heating rate, retention time, cooling temperature and cooling rate being substantially identical to the first heat treatment. Further, V-notched test pieces of standard dimension may be prepared in conformity with JIS Z 2202, and the Charpy impact test can be applied to the test pieces at −30° C. with the repetition frequency n being three in conformity with JIS Z 2242, and Charpy absorbed energy may be evaluated by the average of the values obtained by the three repeated measurements.

The exemplary results are shown in Table 3. Steels A to E contain components within the ranges specified according to the present invention, and fulfill the target levels of strength, low temperature toughness and weld heat-affected zone toughness. On the other hand, steel F has a C amount and steel I an Mn amount smaller than those in the ranges specified in the present invention and therefore the strength is low. Steel G has a C amount, steel H an Si amount, steel J an Mn amount, and steel K an Mo amount larger than those in the ranges specified in the present invention and therefore low temperature toughness, low temperature toughness reliability and weld heat-affected zone toughness are deteriorated. Steel L has an Nb amount larger than that in the range specified in the present invention, and therefore, though the Charpy absorbed energy at −40° C. is good, low temperature toughness reliability and weld heat-affected zone toughness are deteriorated. Steel M has a still larger Nb amount than steel L and therefore low temperature toughness, low temperature toughness reliability and weld heat-affected zone toughness are deteriorated. Steels N, O, P and R have a Ti amount, a V amount, an N amount and an S amount, respectively, larger than those in the ranges specified in the present invention, and therefore, low temperature toughness, low temperature toughness reliability and weld heat-affected zone toughness are deteriorated. Steel Q has an Al amount larger than that in the range specified in the present invention and therefore weld heat-affected zone toughness is deteriorated.

TABLE 1

Chemical components (mass percent), Ceq and Pcm of steel material

| | Chemical components (mass percent) | | | | | | | | | | |
|---|---|---|---|---|---|---|---|---|---|---|---|
| Steel | C | Si | Mn | P | S | Ni | Mo | Nb | Ti | Al | N |
| A | 0.03 | 0.10 | 1.95 | 0.005 | 0.0005 | 0.50 | 0.30 | 0.005 | 0.008 | 0.015 | 0.0023 |
| B | 0.05 | 0.25 | 1.85 | 0.008 | 0.0006 | 0.90 | 0.45 | 0.007 | 0.005 | 0.020 | 0.0015 |
| C | 0.04 | 0.15 | 1.90 | 0.003 | 0.0008 | 2.00 | 0.20 | 0.009 | 0.010 | 0.008 | 0.0030 |
| D | 0.06 | 0.25 | 1.90 | 0.004 | 0.0003 | 1.80 | 0.40 | 0.003 | 0.009 | 0.010 | 0.0025 |
| E | 0.05 | 0.10 | 1.96 | 0.004 | 0.0010 | 1.00 | 0.10 | 0.009 | 0.005 | 0.020 | 0.0015 |
| F | 0.01 | 0.25 | 1.85 | 0.005 | 0.0010 | 1.20 | 0.35 | 0.004 | 0.011 | 0.015 | 0.0032 |
| G | 0.15 | 0.15 | 1.95 | 0.007 | 0.0006 | 0.60 | 0.26 | 0.007 | 0.011 | 0.012 | 0.0033 |
| H | 0.07 | 1.00 | 2.12 | 0.009 | 0.0018 | 0.30 | 0.48 | 0.009 | 0.011 | 0.023 | 0.0032 |
| I | 0.04 | 0.26 | 1.00 | 0.010 | 0.0026 | 0.50 | 0.52 | 0.002 | 0.009 | 0.015 | 0.0025 |
| J | 0.05 | 0.35 | 3.00 | 0.006 | 0.0003 | 0.32 | 0.42 | 0.001 | 0.005 | 0.026 | 0.0016 |
| K | 0.09 | 0.48 | 2.05 | 0.008 | 0.0005 | 0.85 | 1.00 | 0.005 | 0.010 | 0.023 | 0.0030 |
| L | 0.04 | 0.55 | 1.98 | 0.009 | 0.0016 | 0.13 | 0.26 | 0.050 | 0.010 | 0.015 | 0.0028 |
| M | 0.04 | 0.55 | 1.96 | 0.009 | 0.0016 | 0.13 | 0.26 | 0.150 | 0.010 | 0.015 | 0.0028 |
| N | 0.03 | 0.49 | 1.91 | 0.005 | 0.0006 | 0.45 | 0.32 | 0.003 | 0.035 | 0.010 | 0.0016 |
| O | 0.07 | 0.15 | 2.00 | 0.006 | 0.0007 | 0.50 | 0.23 | 0.002 | 0.012 | 0.030 | 0.0035 |
| P | 0.08 | 0.05 | 2.16 | 0.007 | 0.0009 | 0.16 | 0.51 | 0.005 | 0.015 | 0.026 | 0.0080 |
| Q | 0.05 | 0.16 | 1.79 | 0.009 | 0.0005 | 0.65 | 0.45 | 0.006 | 0.012 | 0.060 | 0.0035 |
| R | 0.04 | 0.20 | 1.95 | 0.007 | 0.0040 | 0.80 | 0.30 | 0.008 | 0.010 | 0.001 | 0.0030 |

A bar—in a cell of a chemical component means that the amount thereof is not larger than the detectable limit.

$$Ceq=C/+Mn/6+(Ni+Cu)/5+(Mo+V+Cr)/5$$

$$Pcm=C+Si/30+(Mn+Cu+Cr)/20+Ni/60+Mo/15+V/10+B+5$$

$$P\text{ value}=2.7C+0.4Si+Mn+0.8Cr+0.45(Ni+Cu)+2V+Mo-0.5(\text{B free steel})$$

$$P\text{ value}=2.7C+0.4Si+Mn+0.8Cr+0.45(Ni+Cu)+2V+1.5Mo(\text{B containing steel})$$

TABLE 2

(continued from Table 1)

| Chemical components (mass percent) | | | | | | | | | |
|---|---|---|---|---|---|---|---|---|---|
| B | V | Cu | Cr | Ca | REM | Mg | P-value | Ceq | Pcm |
| 0.0010 | 0.080 | 0.30 | 0.30 | — | — | — | 3.24 | 0.540 | 0.200 |
| — | — | 0.50 | 0.60 | 0.0012 | — | 0.0010 | 3.15 | 0.662 | 0.251 |
| 0.0023 | 0.040 | — | — | — | 0.0008 | — | 3.35 | 0.538 | 0.202 |

TABLE 2-continued (continued from Table 1)

| Chemical components (mass percent) | | | | | | | | | |
|---|---|---|---|---|---|---|---|---|---|
| B | V | Cu | Cr | Ca | REM | Mg | P-value | Ceq | Pcm |
| — | 0.050 | 0.30 | 0.30 | — | — | — | 3.35 | 0.667 | 0.255 |
| 0.0010 | — | — | 0.60 | — | — | — | 3.22 | 0.583 | 0.210 |
| 0.0010 | 0.030 | 0.30 | 0.30 | — | — | 0.0005 | 3.48 | 0.554 | 0.192 |
| 0.0008 | — | 0.23 | 0.50 | — | — | — | 3.58 | 0.682 | 0.320 |
| — | 0.040 | 0.16 | 0.50 | — | 0.0008 | — | 3.38 | 0.658 | 0.283 |
| 0.0008 | 0.030 | 0.65 | 0.32 | — | — | — | 2.83 | 0.457 | 0.197 |
| 0.0015 | 0.026 | 0.26 | 0.45 | 0.002 | — | — | 4.58 | 0.768 | 0.291 |
| 0.0016 | — | 0.32 | 0.26 | — | — | — | 4.72 | 0.762 | 0.326 |
| 0.0013 | 0.050 | 0.15 | 0.52 | — | — | — | 3.32 | 0.551 | 0.221 |
| 0.0013 | 0.050 | 0.15 | 0.52 | — | — | — | 3.32 | 0.551 | 0.221 |
| 0.0010 | 0.030 | 0.51 | 0.23 | 0.0023 | — | 0.0002 | 3.34 | 0.528 | 0.215 |
| — | 0.150 | 0.30 | 0.42 | — | — | — | 2.98 | 0.617 | 0.250 |
| 0.0026 | 0.040 | 0.23 | 0.26 | — | 0.0005 | — | 3.82 | 0.628 | 0.268 |
| 0.0023 | — | 0.32 | 0.59 | 0.0021 | — | — | 3.57 | 0.621 | 0.243 |
| 0.0008 | 0.050 | 0.30 | 0.30 | — | — | — | 3.42 | 0.568 | 0.217 |

TABLE 3

Evaluation result

| | | Mechanical properties of steel material | | | Low temperature toughness | Average prior austenite grain | Bainite and martensite | Weld heat-affected zone toughness | |
|---|---|---|---|---|---|---|---|---|---|
| | | | | | | | | | Condition |
| Performance No. | Steel | YS MPa | TS MPa | vE-40 J | reliability, % | diameter, μm | fraction, % | Condition 1, J | 2, J |
| 1 | A | 890 | 1000 | 280 | 95 | 4.5 | 100 | 130 | 110 |
| 2 | B | 917 | 1030 | 230 | 93 | 5.1 | 100 | 125 | 105 |
| 3 | C | 872 | 980 | 290 | 96 | 4.2 | 100 | 162 | 142 |
| 4 | D | 904 | 1016 | 245 | 97 | 6.1 | 100 | 156 | 136 |
| 5 | E | 908 | 1020 | 225 | 94 | 4.6 | 100 | 166 | 146 |
| 6 | F | 703 | 790 | 210 | 86 | 7.5 | 81 | 140 | 130 |
| 7 | G | 1113 | 1250 | 56 | 75 | 4.6 | 100 | 65 | 45 |
| 8 | H | 966 | 1085 | 80 | 79 | 7.5 | 100 | 43 | 23 |
| 9 | I | 694 | 780 | 205 | 86 | 4.3 | 80 | 130 | 110 |
| 10 | J | 1077 | 1210 | 60 | 75 | 4.5 | 100 | 80 | 60 |
| 11 | K | 1028 | 1155 | 150 | 82 | 5.3 | 100 | 82 | 62 |
| 12 | L | 908 | 1020 | 205 | 84 | 6.2 | 100 | 75 | 55 |
| 13 | M | 1086 | 1220 | 80 | 80 | 4.3 | 100 | 45 | 25 |
| 14 | N | 890 | 1000 | 85 | 82 | 5.2 | 100 | 65 | 45 |
| 15 | O | 1041 | 1170 | 150 | 82 | 4.6 | 100 | 75 | 55 |
| 16 | P | 1050 | 1180 | 130 | 82 | 5.2 | 100 | 50 | 30 |
| 17 | Q | 908 | 1020 | 200 | 85 | 3.8 | 100 | 66 | 46 |
| 18 | R | 890 | 1000 | 80 | 80 | 3.2 | 100 | 45 | 25 |

vE-40 is Charpy absorbed energy measured at −40° C. with the repetition frequency n being three. Weld heat-affected zone toughness is Charpy absorbed energy measured at −30° C. with the repetition frequency n being three. The conditions of weld heat-affected zone toughness are identical to the heat treatment conditions of weld reproducing heat cycle test.

Heating rate: 100° C./sec., retention time: 1 sec., cooling temperature range: 500° C. to 800° C., cooling rate: 15° C./sec.

Condition 1: both first and second heating temperatures are 1,400° C.

Condition 2: first heating temperature is 1,400° C. and second is 900° C.

EXAMPLE 2

Steel plates 10 to 20 mm in thickness, the steel sheets containing the chemical components of steels A to E shown in Tables 1 and 2, can be produced under the same conditions as Example 1. Thereafter, the steel plates may be subjected to cold forming, then submerged arc welding at a heat input of 2.0 to 3.0 kJ/mm on each of the inner surfaces and at a heat input of 2.0 to 3.0 kJ/mm on each of the outer surfaces, thereafter pipe expansion, and, by so doing, steel pipes 700 to 920 mm in outer diameter may be produced. An average diameter of prior austenite grains and a bainite and martensite fraction in the base steel of each of the steel pipes can be obtained in the same manner as Example 1. Further, tensile properties of each of the steels may be evaluated by the API full thickness tensile test. Low temperature toughness was evaluated, as in Example 1, by the average value of absorbed energy and the low temperature toughness reliability of a Charpy impact test piece prepared so that the length thereof may be in the C direction. Weld heat-affected zone toughness can be evaluated by subjecting a test piece having a notch at an intersection or a portion 1 mm apart from an intersection to another Charpy impact test at −30° C.

The results are shown in Table 4. In any of the steels, the tensile strength of the base steel is not lower than 800 MPa, the toughness of the base steel is extremely good; the Charpy absorbed energy at −40° C. is not lower than 200 J and the low temperature toughness reliability is not less than 85%. With respect to a weld heat-affected zone, the Charpy absorbed energy at −30° C. is not lower than 100 J and the weld heat-affected zone toughness is also excellent.

TABLE 4

| Evaluation result | | | | | | | | | |
|---|---|---|---|---|---|---|---|---|---|
| | | Mechanical properties of steel pipe | | | Low temperature toughness | Average prior austenite grain | Bainite and martensite | Weld heat-affected zone toughness | |
| Performance No. | Steel | YS MPa | TS MPa | vE-40 J | reliability, % | diameter, μm | fraction, % | Notch position 1, J | Notch position 2, J |
| 19 | A | 917 | 1030 | 260 | 90 | 4.5 | 100 | 205 | 175 |
| 20 | B | 935 | 1050 | 210 | 93 | 5.1 | 100 | 180 | 150 |
| 21 | C | 890 | 1000 | 270 | 94 | 4.2 | 100 | 162 | 132 |
| 22 | D | 922 | 1036 | 225 | 90 | 6.1 | 100 | 145 | 115 |
| 23 | E | 935 | 1050 | 215 | 86 | 4.6 | 100 | 148 | 118 |

Notch position 1 means a mating portion and notch position 2 means a portion 1 mm away from a mating portion.

EXAMPLE 3

In a substantially the same manner as Example 1, castings can be produced from a steel containing chemical components of steel A shown in Tables 1 and 2 and, thereafter, the castings may be hot rolled under the conditions shown in Table 5 and cooled and, by so doing, steel plates 10 to 20 mm in thickness were produced. In the same manner as Example 1, an average diameter of prior austenite grains and a bainite and martensite fraction can be obtained, and tensile properties were evaluated by the API full thickness tensile test. Low temperature toughness was evaluated, as for Example 1, by the average value of absorbed energy and the low temperature toughness reliability of a Charpy impact test piece prepared so that the length thereof may be in the C direction. Weld heat-affected zone toughness may be evaluated by subjecting a test piece to a weld-reproducing heat cycle test and then a Charpy impact test at −30° C.

The results are shown in Table 6. In any of the steels, the tensile strength of the base steel is not lower than 800 MPa, with respect to the toughness of the base steel, the Charpy absorbed energy at −40° C. is not lower than 200 J and the low temperature toughness reliability is not less than 85% and, with respect to the weld heat-affected zone, the Charpy absorbed energy at −30° C. is not lower than 100 J and, therefore, an ultra-high-strength steel plate excellent in weld heat-affected zone toughness is obtained. Further, steels 27 and 28 produced under the conditions in the ranges specified according to particular embodiments the present invention have more excellent low temperature toughness reliability than steels 24 to 26 produced under conditions different from those specified in those embodiments.

TABLE 5

| Hot-rolling condition | | | | | | | | |
|---|---|---|---|---|---|---|---|---|
| | | Hot rolling condition | | | | | | |
| | | Heating | Recrystallization rolling | | Unrecrystallization rolling | | Water cooling | |
| Performance No. | Steel | temperature, ° C. | Start temperature, ° C. | End temperature, ° C. | Start temperature, ° C. | End temperature, ° C. | Stop temperature, ° C. | Cooling rate, ° C./sec. |
| 24 | A | 1350 | 900 | 850 | 830 | 730 | 400 | 20 |
| 25 | A | 1100 | 980 | 930 | 850 | 810 | 600 | 20 |

TABLE 5-continued

| | | Hot-rolling condition | | | | | | |
|---|---|---|---|---|---|---|---|---|
| | | Hot rolling condition | | | | | | |
| | | Heating | Recrystallization rolling | | Unrecrystallization rolling | | Water cooling | |
| Performance No. | Steel | temperature, ° C. | Start temperature, ° C. | End temperature, ° C. | Start temperature, ° C. | End temperature, ° C. | Stop temperature, ° C. | Cooling rate, ° C./sec. |
| 26 | A | 1100 | 960 | 900 | 880 | 800 | 200 | 0.5 |
| 27 | A | 1150 | 970 | 930 | 850 | 790 | 350 | 40 |
| 28 | A | 1100 | 1000 | 950 | 870 | 780 | 400 | 15 |

TABLE 6

| | | Evaluation result | | | | | | | |
|---|---|---|---|---|---|---|---|---|---|
| | | Mechanical properties of steel material | | | Low temperature toughness | Average prior austenite grain | Bainite and martensite | Weld heat-affected zone toughness | |
| Performance No. | Steel | YS MPa | TS MPa | vE-40 J | reliability, % | diameter, μm | fraction, % | Condition 1, J | Condition 2, J |
| 24 | A | 872 | 980 | 210 | 85 | 5.1 | 100 | 205 | 175 |
| 25 | A | 792 | 890 | 205 | 88 | 4.5 | 93 | 210 | 180 |
| 26 | A | 757 | 850 | 210 | 87 | 4.8 | 91 | 202 | 172 |
| 27 | A | 890 | 1000 | 260 | 95 | 3.5 | 100 | 223 | 193 |
| 28 | A | 872 | 980 | 250 | 96 | 4.2 | 100 | 215 | 185 |

vE-40 is Charpy absorbed energy measured at −40° C. with the repetition frequency n being three.
Weld heat-affected zone toughness is Charpy absorbed energy measured at −30° C. with the repetition frequency n being three.
The conditions of weld heat-affected zone toughness are identical to the heat treatment conditions of weld reproducing heat cycle test.
Heating rate: 100° C./sec., retention time: 1 sec., cooling temperature range: 500° C. to 800° C., cooling rate: 15° C./sec.
Condition 1: both first and second heating temperatures are 1,400° C.
Condition 2: first heating temperature is 1,400° C. and second is 900° C.

EXAMPLE 4

Steels containing chemical compositions shown in Table 7 can be melted and continuously cast into castings. The resulting castings may be reheated to 1,100° C., thereafter rolled in the recrystallization temperature range from 900° C. to 1,100° C., further rolled at a reduction ratio of 5 in the uncrystallization temperature range from 750° C. to 880° C., and thereafter cooled at a cooling rate of 5 to 50° C./sec. up to a temperature not higher than 420° C. by water cooling and, by so doing, steel sheets 16 mm in thickness can be produced. An average diameter of prior austenite grains may be obtained by the straight line crossing segment method in conformity with JIS G 0551.

Yield strength and tensile strength in the C direction of a steel sheet can be evaluated by the API full thickness tensile test. A Charpy absorbed energy may be evaluated by carrying out a Charpy impact test at −40° C. with the test repetition frequency n being three in conformity with JIS Z 2242 by using V-notched test pieces of a standard size, the length of the test pieces being in the C direction, prepared in conformity with JIS Z 2202. Weld heat-affected zone toughness can be evaluated in the same manner as Example 1. In addition, for simulating HAZ thermal cycle, specimens may be subjected to heat treatment twice, then heated to 350° C. and held for five minutes at the temperature.

Further, the value TS/0.7(3,720C+869) may be calculated from a value of tensile strength and a C amount. When a bainite and martensite fraction is within the range from 90 to 100%, the following expression is satisfied;

$$TS/(3{,}720C+869)>0.7,$$

wherein TS is tensile strength of a steel obtained (in terms of MPa) and C is a C amount (in terms of mass percent).

In Table 8, steels AA to AF, AH, AJ, AK, and AP to AR are steels that contain components within the ranges specified in the present invention, and have the target levels of strength, low temperature toughness and weld heat-affected zone toughness. On the other hand, steel AG has a C amount larger than that in the range specified in the present invention and therefore the low temperature toughness of the base steel and the weld heat-affected zone toughness are deteriorated. Further, steel AI has an Mn amount smaller than that in the range specified in the present invention and therefore the microstructure does not consist of a bainite and martensite dominant structure and the strength and the low temperature toughness are deteriorated. Steels AL and AM have an Nb amount and steel AN a Ti amount larger than those in the ranges specified in the present invention and, therefore, coarse crystal grains are partially generated, the Charpy absorbed energy of the base steel is deteriorated in some of the test pieces, and also the weld heat-affected zone toughness is deteriorated. Steel AO has a P value smaller than that in the range specified in the present invention and therefore the tensile strength is deteriorated.

TABLE 7

Chemical components of steel material (mass percent)

| Steel | Chemical components (mass percent) | | | | | | | | | | |
|---|---|---|---|---|---|---|---|---|---|---|---|
| | C | Si | Mn | P | S | Ni | Mo | Nb | Ti | Al | N |
| AA | 0.03 | 0.10 | 1.95 | 0.005 | 0.0005 | 0.50 | 0.30 | 0.005 | 0.009 | 0.015 | 0.0023 |
| AB | 0.05 | 0.25 | 1.85 | 0.008 | 0.0006 | 0.90 | 0.45 | 0.007 | 0.005 | 0.020 | 0.0015 |
| AC | 0.04 | 0.15 | 1.90 | 0.003 | 0.0008 | 1.91 | 0.20 | 0.004 | 0.012 | 0.008 | 0.0030 |
| AD | 0.06 | 0.25 | 1.90 | 0.004 | 0.0003 | 1.80 | 0.40 | 0.003 | 0.009 | 0.010 | 0.0025 |
| AE | 0.05 | 0.10 | 1.96 | 0.004 | 0.0010 | 1.00 | 0.10 | 0.009 | 0.007 | 0.020 | 0.0016 |
| AF | 0.02 | 0.25 | 1.85 | 0.005 | 0.0010 | 1.20 | 0.35 | 0.004 | 0.011 | 0.015 | 0.0032 |
| AG | 0.15 | 0.15 | 1.60 | 0.007 | 0.0006 | 0.60 | 0.26 | 0.007 | 0.014 | 0.012 | 0.0033 |
| AH | 0.07 | 0.54 | 2.12 | 0.009 | 0.0018 | 0.30 | 0.48 | 0.009 | 0.014 | 0.023 | 0.0032 |
| AI | 0.04 | 0.26 | 1.00 | 0.010 | 0.0026 | 0.50 | 0.52 | 0.002 | 0.009 | 0.015 | 0.0025 |
| AJ | 0.05 | 0.35 | 2.20 | 0.006 | 0.0003 | 0.32 | 0.42 | 0.001 | 0.005 | 0.026 | 0.0016 |
| AK | 0.09 | 0.48 | 2.05 | 0.008 | 0.0005 | 0.85 | 0.64 | 0.005 | 0.013 | 0.023 | 0.0030 |
| AL | 0.04 | 0.55 | 1.96 | 0.009 | 0.0016 | 0.13 | 0.26 | 0.042 | 0.012 | 0.015 | 0.0028 |
| AM | 0.04 | 0.55 | 1.96 | 0.009 | 0.0016 | 0.13 | 0.26 | 0.079 | 0.014 | 0.015 | 0.0028 |
| AN | 0.03 | 0.48 | 1.91 | 0.005 | 0.0006 | 0.45 | 0.32 | 0.003 | 0.064 | 0.010 | 0.0016 |
| AO | 0.04 | 0.15 | 1.60 | 0.006 | 0.0007 | 0.10 | 0.23 | 0.002 | 0.012 | 0.030 | 0.0035 |
| AP | 0.08 | 0.05 | 2.20 | 0.007 | 0.0009 | 0.16 | 0.51 | 0.005 | 0.015 | 0.026 | 0.0025 |
| AQ | 0.04 | 0.16 | 1.79 | 0.009 | 0.0005 | 0.65 | 0.72 | 0.006 | 0.013 | 0.062 | 0.0035 |
| AR | 0.04 | 0.20 | 1.95 | 0.007 | 0.0012 | 0.80 | 0.30 | 0.008 | 0.012 | 0.001 | 0.0030 |

| Steel | Chemical components (mass percent) | | | | | | | P-value |
|---|---|---|---|---|---|---|---|---|
| | B | V | Cu | Cr | Ca | REM | Mg | |
| AA | 0.0011 | 0.060 | 0.30 | 0.30 | — | — | — | 3.24 |
| AB | — | — | 0.50 | 0.60 | 0.0012 | — | 0.0010 | 3.15 |
| AC | 0.0017 | — | — | — | — | — | — | 3.23 |
| AD | — | 0.050 | 0.30 | 0.30 | — | — | — | 3.35 |
| AE | 0.0010 | — | — | 0.60 | — | — | — | 3.22 |
| AF | 0.0013 | 0.030 | 0.30 | 0.30 | — | — | 0.0005 | 3.50 |
| AG | 0.0008 | — | 0.00 | 0.00 | — | — | — | 2.73 |
| AH | — | 0.040 | 0.16 | 0.50 | — | 0.0008 | — | 3.19 |
| AI | 0.0008 | 0.030 | 0.65 | 0.32 | — | — | — | 2.83 |
| AJ | 0.0015 | 0.026 | 0.26 | 0.45 | 0.002 | — | — | 3.78 |
| AK | 0.0000 | — | 0.00 | 0.00 | — | — | — | 3.83 |
| AL | 0.0013 | 0.050 | 0.15 | 0.52 | — | — | — | 3.32 |
| AM | 0.0013 | 0.050 | 0.15 | 0.52 | — | — | — | 3.32 |
| AN | 0.0010 | 0.030 | 0.51 | 0.23 | 0.0023 | — | 0.0002 | 3.34 |
| AO | — | 0.000 | 0.30 | 0.00 | — | — | — | 1.68 |
| AP | 0.0000 | 0.240 | 0.00 | 0.00 | — | 0.0005 | — | 3.75 |
| AQ | 0.0016 | — | 0.00 | 0.00 | 0.0021 | — | — | 3.33 |
| AR | 0.0008 | 0.000 | 0.00 | 0.00 | — | — | — | 2.95 |

A bar - in a cell of a chemical component means that the amount thereof is not larger than the detectable limit.

P value = 2.7C + 0.4Si + Mn + 0.8Cr + 0.45(Ni + Cu) + 2V + Mo − 0.5(B free steel)

P value = 2.7C + 0.4Si + Mn + 0.8Cr + 0.45(Ni + Cu) + 2V + 1.5Mo(B containing steel)

TABLE 8

Test conditions and evaluation result

| Performance | | Mechanical properties of steel | | | | Average prior austenite grain | | Weld heat-affected zone toughness | | | |
|---|---|---|---|---|---|---|---|---|---|---|---|
| | | TS | vE-40 | | | diameter, | TS/ | Condition 1 | Condition 2 | Condition 3 | Condition 4 |
| No. | Steel | MPa | J | J | J | μm | (3720[C] + 869) | J | J | J | J |
| 29 | AA | 930 | 280 | 276 | 281 | 4.5 | 0.948 | 134 | 110 | 138 | 162 |
| 30 | AB | 946 | 230 | 241 | 208 | 5.1 | 0.897 | 133 | 105 | 154 | 129 |
| 31 | AC | 980 | 290 | 277 | 281 | 4.2 | 0.963 | 156 | 142 | 180 | 174 |
| 32 | AD | 1016 | 221 | 205 | 198 | 6.1 | 0.930 | 153 | 136 | 175 | 151 |
| 33 | AE | 1020 | 225 | 204 | 212 | 4.6 | 0.967 | 165 | 146 | 179 | 188 |
| 34 | AF | 830 | 233 | 245 | 242 | 7.5 | 0.880 | 141 | 130 | 159 | 148 |
| 35 | AG | 1202 | 96 | 102 | 111 | 4.6 | 0.842 | 51 | 23 | 51 | 34 |
| 36 | AH | 1021 | 211 | 203 | 199 | 7.5 | 0.904 | 117 | 101 | 127 | 127 |
| 37 | AI | 698 | 164 | 157 | 123 | 4.3 | 0.686 | 87 | 110 | 100 | 111 |
| 38 | AJ | 1012 | 214 | 222 | 231 | 4.5 | 0.959 | 122 | 102 | 147 | 176 |
| 39 | AK | 1155 | 203 | 201 | 203 | 5.3 | 0.959 | 124 | 103 | 151 | 142 |
| 40 | AL | 987 | 242 | 64 | 202 | 6.2 | 0.970 | 87 | 55 | 88 | 43 |
| 41 | AM | 998 | 228 | 76 | 102 | 4.3 | 0.981 | 67 | 25 | 60 | 25 |

TABLE 8-continued

| Test conditions and evaluation result | | | | | | | | | | | |
|---|---|---|---|---|---|---|---|---|---|---|---|
| | | Mechanical properties of steel | | | | Average prior austenite grain | | Weld heat-affected zone toughness | | | |
| Performance | | TS | vE-40 | | | diameter, | TS/ | Condition 1 | Condition 2 | Condition 3 | Condition 4 |
| No. | Steel | MPa | J | J | J | μm | (3720[C] + 869) | J | J | J | J |
| 42 | AN | 931 | 85 | 243 | 221 | 5.2 | 0.949 | 65 | 45 | 64 | 22 |
| 43 | AO | 724 | 156 | 143 | 161 | 4.6 | 0.711 | 69 | 55 | 88 | 57 |
| 44 | AP | 977 | 201 | 210 | 206 | 5.2 | 0.837 | 128 | 102 | 147 | 133 |
| 45 | AQ | 994 | 248 | 223 | 254 | 3.8 | 0.977 | 134 | 134 | 160 | 179 |
| 46 | AR | 961 | 222 | 218 | 218 | 3.2 | 0.944 | 108 | 121 | 162 | 177 |

vE-40 is Charpy absorbed energy measured at −40° C. with the repetition frequency n being three.
Weld heat-affected zone toughness is Charpy absorbed energy measured at −30° C. with the repetition frequency n being three.
The conditions of weld heat-affected zone toughness are identical to the heat treatment conditions of weld reproducing heat cycle test.
Heating rate: 100° C./sec., retention time: 1 sec., cooling temperature range: 500° C. to 800° C., cooling rate: 15° C./sec.
Condition 1: both first and second heating temperatures are 1,400° C.
Condition 2: first heating temperature is 1,400° C. and second is 900° C.
Condition 3: both first and second heating temperatures are 1,400° C., and then heated to 350° C. and retained for 5 minutes.
Condition 4: first heating temperature is 1,400° C. and second is 900° C., and then heated to 350° C. and retained for 5 minutes.

EXAMPLE 5

The steel plates containing the chemical components of steels AA to AE shown in Table 7 can be produced in a substantially the same manner as provided in Example 4, then formed into pipes in a UO process, and subjected to submerged arc welding at a heat input of 2.0 to 3.0 kJ/mm on each of the inner surfaces and at a heat input of 2.0 to 3.0 kJ/mm on each of the outer surfaces. Subsequently, some of the steel pipes may be heated to 350° C. at the seam welds by induction heating and then held for five minutes, and thereafter cooled to the room temperature and subjected to pipe expansion, while some of the steel pipes can be subjected to pipe expansion without heating the seam welds.

For investigating the mechanical properties of the base steels of those steel pipes, in the same manner as in Example 4, an API full thickness tensile test and a Charpy impact test may be carried out, the Charpy impact test being carried out at −40° C. using test pieces having the length in the C direction. The Charpy absorbed energy can be obtained by measuring it with the repetition frequency n being three and averaging the three measured values. Further, weld heat-affected zone toughness may be obtained by carrying out another Charpy impact test at −30° C. with the repetition frequency n being three using test pieces each having a notch at an intersection or a portion 1 mm apart from an intersection and then averaging the resulting values.

Exemplary results are shown in Table 9. In Table 9, "As welded" in the column "Weld heat-affected zone toughness" represents the weld heat-affected zone toughness of a steel pipe subjected to pipe expansion without the heating of a seam weld and "Heat treatment" represents the weld heat-affected zone toughness of a steel pipe subjected to pipe expansion after a seam weld is heated by induction heating. In any of steels AA to AE, the tensile strength of the base steel is not lower than 900 MPa and, with respect to the toughness of the base steel, the Charpy absorbed energy at −40° C. is not lower than 200 J, and with respect to the toughness at the weld heat-affected zone, the Charpy absorbed energy at −30° C. is not lower than 100 J. Therefore, high-strength steel pipes excellent in the low temperature toughness of the base steel and weld heat-affected zone toughness are obtained.

TABLE 9

| Test conditions and evaluation result | | | | | | | | | | |
|---|---|---|---|---|---|---|---|---|---|---|
| | | | | | | | Weld heat-affected zone toughness | | | |
| | | Mechanical properties of steel pipe | | | Prior | | As welded | | Heat treatment | |
| Performance | | YS | TS | vE-40 | austenite | TS/ | Notch position | Notch position | Notch position 1, | Notch position 2, |
| No. | Steel | MPa | MPa | J | μm | (3720[C] + 869) | J | J | J | J |
| 47 | AA | 867 | 963 | 278 | 4.5 | 0.948 | 178 | 165 | 205 | 184 |
| 48 | AB | 904 | 972 | 228 | 5.1 | 0.897 | 180 | 150 | 181 | 178 |
| 49 | AC | 940 | 1001 | 282 | 4.2 | 0.963 | 162 | 132 | 175 | 169 |
| 50 | AD | 963 | 1036 | 207 | 6.1 | 0.93 | 145 | 115 | 169 | 168 |
| 51 | AE | 988 | 1040 | 217 | 4.6 | 0.967 | 148 | 118 | 165 | 169 |

Notch position 1 means a mating portion and notch position 2 means a portion 1 mm away from a mating portion.

What is claimed is:

1. A high-strength steel pipe having a high low temperature toughness reliability and a high weld heat-affected zone toughness, comprising:

a seam-welded portion having multiple layers obtained by applying multi-layer welding, wherein the portion is at least twice heated; and a base steel portion containing, in mass:

C: 0.02 to 0.07%,
Si: not more than 0.6%,
Mn: 1.5 to 2.5%,
P: not more than 0.015%,
S: not more than 0.003%,
Ni: 0.01 to 2.0%,
Mo: 0.1 to 0.8%,
Nb: 0.001% to 0.005%
Ti: 0.005% to 0.030%,
B: 0.0003 to 0.0030%,
Al: not more than 0.070%, and
N: not more than 0.0060%, so as to satisfy the expression $Ti-3.4N \geqq 0$, wherein a balance of the base steel portion consists of Fe and unavoidable impurities, and the base steel portion does not contain Mg, wherein a P value of the steel is provided in a range of 2.5 and 4.0, wherein a microstructure of the steel being composed of martensite and bainite in the range from 90 to 100% in terms of a bainite and martensite fraction, and wherein the P value is defined by:

$$P=2.7C+0.4Si+Mn+0.8Cr+0.45(Ni+Cu)+2V+1.5Mo,$$

so that the mother alloy of the pipe has a compositionally-derived high low temperature toughness reliability and the at least twice heated seam-welded portion has a compositionally-derived high heat-affected zone toughness after multiple welding-heatings, and wherein the high-strength steel pipe has tensile strength of not lower than 800 MPa and Charpy absorbed energy of the base steel is not lower than 200J at −40° C.

2. The pipe according to claim 1, wherein the amount of Nb is 0.001% to 0.004%.

3. A high-strength steel pipe having a high low temperature toughness reliability and a high weld heat-affected zone toughness, comprising:

a seam-welded portion having multiple layers obtained by applying multi-layer welding, wherein the portion is at least twice heated: and a base steel portion containing, in mass:

C: 0.02 to less than 0.05%,
Si: not more than 0.6%,
Mn: 1.5 to 2.5%,
P: not more than 0.015%,
S: not more than 0.001%,
Ni: 0.01 to 2.0%,
Mo: 0.1 to 0.8%,
Nb: 0.001% to 0.005%,
Ti: 0.005% to 0.030%,
B: 0.0003 to 0.0030%,
Al: not more than 0.070%, and
N: not more than 0.0060%, so as to satisfy the expression $Ti-3.4N \geqq 0$, wherein the base steel portion further includes one or more of:
V: 0.001 to 0.10%,
Cu: 0.01 to 1.0%, and
Cr: 0.01 to 1.0%, with the balance consisting of Fe and unavoidable impurities, and the base steel portion does not contain Mg, wherein a microstructure of the steel is composed of martensite and bainite in the range from 90 to 100% in terms of a bainite and martensite fraction; and an average diameter of a prior austenite grains in the pipe being not larger than 10 μm, wherein a P value of the steel is in the range from 2.5 to 4.0, and defined as follows:

$$P+2.7C+0.4Si+Mn+0.8Cr+0.45(Ni+Cu)+2V+1.5Mo,$$

so that the mother alloy of the pipe has a compositionally-derived high low temperature toughness reliability and the at least twice heated seam-welded portion has a compositionally-derived high heat-affected zone toughness after multiple welding-heatings, and wherein the high-strength steel pipe has tensile strength of not lower than 800 MPa and Charpy absorbed energy of the base steel is not lower than 200J at −40° C.

4. The pipe according to claim 3, wherein the amount of Nb is 0.001% to 0.004%.

5. A high-strength steel pipe having a high low temperature toughness reliability and a high weld heat-affected zone toughness, comprising:

a seam-welded portion having multiple layers obtained by applying multi-layer welding, wherein the portion is at least twice heated; and a base steel portion containing, in mass:

C: 0.02 to less than 0.05%,
Si: not more than 0.6%,
Mn: 1.5 to 2.5%,
P: not more than 0.015%,
S: not more than 0.003%,
Ni: 0.01 to 2.0%,
Mo: 0.1 to 0.8%,
Nb: 0.001% to 0.005%,
Ti: 0.005% to 0.030%,
B: 0.0003 to 0.0030%,
Al: not more than 0.070%, and
N: not more than 0.0060%, so as to satisfy the expression $Ti-3.4N \geqq 0$, wherein the base steel portion further includes one or more of:
V: 0.001 to 0.10%,
Cu: 0.01 to 1.0%,
Cr: 0.01 to 1.0%, and
Ca: 0.0001 to 0.01%, with the balance consisting of Fe and unavoidable impurities and the base steel portion does not contain Mg, wherein a microstructure of the steel is composed of martensite and bainite in the range from 90 to 100% in terms of a bainite and martensite fraction; and an average diameter of a prior austenite grains in the pipe being not larger than 10 μm, wherein a P value of the steel is in the range from 2.5 to 4.0, and defined as follows:

$$P=2.7C+0.4Si+Mn+0.8Cr+0.45(Ni+Cu)+2V+1.5Mo,$$

so that the mother alloy of the pipe has a compositionally-derived high low temperature toughness reliability and the at least twice heated seam-welded portion has a compositionally-derived high heat-affected zone toughness after multiple welding-heatings, and wherein the high-strength steel pipe has tensile strength of not lower than 800 MPa and Charpy absorbed energy of the base steel is not lower than 200J at −40° C.

6. The pipe according to claim 5, wherein the amount of Nb is 0.001% to 0.004%.

7. A high-strength steel pipe having a high low temperature toughness reliability and a high weld heat-affected zone toughness, comprising:

a seam-welded portion having multiple layers obtained by applying multi-layer welding; and a base steel portion containing, in mass:

C: 0.02 to 0.07%,

Si: not more than 0.6%,

Mn: 1.5 to 2.5%,

P: not more than 0.015%,

S: not more than 0.003%,

Ni: 0.01 to 2.0%,

Mo: 0.2 to 0.8%,

Nb: 0.001% to 0.005%,

Ti: 0.005% to 0.030%,

Al: not more than 0.070%, and

N: not more than 0.0060%, wherein a balance of the base steel portion consists of Fe and unavoidable impurities, and the base steel portion does not contain Mg, wherein a P value of the steel is provided in a range of 1.9 and 4.0, wherein a microstructure of the steel being composed of martensite and bainite in the range from 90 to 100% in terms of a bainite and martensite fraction, wherein the P value is defined by:

$$P=2.7C+0.4Si+Mn+0.8Cr+0.45(Ni+Cu)+2V+Mo-0.5,$$

and wherein the high-strength steel pipe has tensile strength of not lower than 800 MPa and Charpy absorbed energy of a the base steel is not lower than 200J at −40° C.

* * * * *